United States Patent [19]

Webb et al.

[11] Patent Number: 4,781,141

[45] Date of Patent: Nov. 1, 1988

[54] PERSONAL WATER CRAFT WITH IMPROVED HULL DESIGN

[75] Inventors: Edward H. Webb, Paynesville, Minn.; Marley Duclo, Hotchkiss, Colo.; Lonn M. Peterson, Moorhead, Minn.

[73] Assignee: Wetjet International, Ltd., Paynesville, Minn.

[21] Appl. No.: 905,863

[22] Filed: Sep. 10, 1986

[51] Int. Cl.[4] ..... B63B 1/32

[52] U.S. Cl. ..... 114/288; 114/57; 114/270; 440/69

[58] Field of Search ..... 114/270, 148, 56, 57, 114/288; 440/38, 40, 41, 42, 43, 46, 47, 88, 89, 69

[56] References Cited

U.S. PATENT DOCUMENTS

| | | | |
|---|---|---|---|
| Re. 30,978 | 6/1982 | Jacobson | 114/270 |
| 1,837,508 | 12/1931 | Volf, Jr. | 440/38 |
| 2,931,134 | 4/1960 | Nevitt | 114/288 |
| 3,076,426 | 2/1963 | Alexander et al. | 440/42 |
| 3,369,518 | 2/1968 | Jacobson | 114/270 |
| 3,608,512 | 9/1971 | Thompson | 114/270 |
| 3,623,447 | 11/1971 | Jacobson | 114/270 |
| 3,948,206 | 4/1976 | Tyler | 114/270 |
| 3,982,497 | 9/1976 | Caron | 114/270 |
| 4,176,613 | 12/1979 | Rickards et al. | 440/47 |
| 4,231,315 | 11/1980 | Tachibana | 440/43 |
| 4,341,177 | 7/1982 | Miyazaki | 114/125 |
| 4,523,536 | 6/1985 | Smoot | 114/67 A |

*Primary Examiner*—Sherman D. Basinger
*Assistant Examiner*—Jesûs D. Sotelo
*Attorney, Agent, or Firm*—Merchant, Gould, Smith, Edell, Welter & Schmidt

[57] ABSTRACT

Improved jet propelled aquatic vessel (1) with a hull (60) profile which increase water entrainment to the jet pump intake orifice (14) and tends to stabilize the vessel. The vessel has a hull (60) with a lowered center section (13) wherein a concave water entrainment groove (15) is located. The vessel includes an operator control panel (43) and an operator support structure (10). The engine (20) is forwardly mounted in a closed engine compartment (21) while the air intake (29) for the engine (20) utilizes a combination of high and low points to avoid flooding of the engine compartment (21) should the vessel (1) capsize. To turn the vessel (1) a jet nozzle (12) is deflected by mechanical linkage (45). The vessel's steering wheel (11) is coordinated with jet nozzle (12) and mechanical linkage (45) to limit maximum deflection.

8 Claims, 4 Drawing Sheets

PERSONAL WATER CRAFT WITH IMPROVED HULL DESIGN

FIELD OF THE INVENTION

The present invention relates generally to a jet powered water craft and more particularly to a water craft utilizing a longitudinally aligned, centrally located sponson in which a concave groove has been formed so as to entrain water directed toward the inlet of a jet pump.

DESCRIPTION OF RELATED TECHNOLOGY

Various types of water jet power driven, aquatic vehicles have been devised and used, but such vehicles have had the operational disadvantages of lateral instability, loss of water entrainment to the jet pump inlet during maximum performance maneuvering, susceptibility to flooding of the engine compartment when swamped or capsized and insufficient attention to safety considerations, such as the entrapment of fuel vapor in unvented portions of the water craft structure.

An early example of a jet powered recreational aquatic vehicle is shown in U.S. Pat. No. 3,369,518, issued to Jacobson. The Jacobson patent discloses an aft mounted impeller 88 ejecting water through nozzle 94, the nozzle being made pivotable by the interconnected movement of handlebars 110 so as to control the direction of the craft. Water is entrained into the intake of the impeller via a rearwardly disposed rectangular opening 30, the entrained water being directed upwardly along an inclined path. Due to the dimunitive size of the vehicle, it must be operated at high speed in order to avoid a substantial degree of submersion. The narrow lateral dimensions of the vehicle require considerable operator skill in maintaining balance and limit the ability of the vehicle to make sharp turns since the lack of frictional contact with the water surface promotes sliding and capsizing of the vehicle during steeply banked manuevers. An alternative embodiment of the vehicle is shown utilizing "wings" 142 which tend to impart additional lateral stability to the vehicle while adding weight and hydrodynamic drag (column 4, lines 13–17).

An improved version of Jacobson's narrow beamed vehicle is disclosed is his subsequent U.S. Pat. No. 3,623,447. This later patent shows a jet propelled boat with a raised deck on either side of a cockpit which is completely open in the rear so that the cockpit floor is normally above the water line. The deck is not provided with rails on the inner portion of the two side decks, which are raised above the level of the cockpit. Also disclosed is a rounded bow section such that when proceeding in calm water in a straight line water does not enter the cockpit at its open aft end, but if a sharp turn is made, waves from the wash can flow in and cover the cockpit floor. The same is true if the boat is proceeding in choppy water and slows down; in such a case the following waves can inundate the cockpit floor. Although the cockpit floor covers an engine compartment that is theoretically water tight, in practice when the cockpit floor is inundated to a substantial depth, hydrostatic pressure can cause water to flow through the floor and into the engine compartment raising the hazard of engine stall and damage under extreme conditions. Although the width of the water craft has been increased somewhat to improve stability, the craft still requires some degree of skill to operate and maintain in an upright position. Prior to starting the engine in the water craft, a fan must be energized for a period of 15 to 20 seconds in order to discharge accumulated gasoline vapors from the engine compartment (column 4, lines 62–66).

Yet another Jacobson patent, U.S. Pat. No. Re. 30,978, attempts to solve the inherent problem of lateral stability in small jet powered recreational water craft. This particular vehicle is inherently self-righting and when unmanned will slowly circle, thereby permitting the displaced rider to swim along a radial path to intercept the craft. This craft also suffers from the problems present in the previous Jacobson vehicles insofar as the jet pump water intake fails to entrain water during sharp cornering, thus resulting in a crucial lack of motive force at the most steeply banked portion of a turn. This lack of continuous jet pump action during a steeply banked turn is one factor which contributes to loss of control of the vehicle, frequently separating the operator of the vehicle from the craft.

The final example of a jet powered water craft requiring a high degree of operator skill in order to maintain upright, forward movement is U.S. Pat. No. 3,948,206. This craft basically has the planform and elevation of an ordinary motorcycle, with the exception that the area that one might normally expect to be occupied by the tires has been replaced at the forward portion by a steerable ski, and at the rear there is a fixed jet pump and ski. Water is channeled into the jet pump through an opening in the rear ski, the jet pump being substantially outboard of the remainder of the vehicle. This vehicle suffers from both lateral instability and the entrainment of air into the jet pump. An attempt is made to reduce the amount of air reaching the jet pump by the use of two channels 174 which are incorporated into rear ski 24, the channels tending to capture air that would otherwise make its way towards the inlet of the jet pump 30 (column 7, lines 22–29).

One problem faced by designers of small recreational water craft is the requirement that the boat be as small and lightweight as possible in order to preserve maximum speed and responsive handling, yet be large and powerful enough to carry two people or perhaps pull a waterskier, while still retaining lateral stability throughout all of its various operational regimes. A traditional approach to solving this problem is illustrated in U.S. Pat. No. 3,982,497, issued to Caron. In order to supply water to the jet pump, a standard rectangular opening is located near the stern of the vessel. In order to prevent air entrainment during high speed turns, the vessel rides fairly low in the water, and in order to prevent cockpit inundation during low speed operations, the cockpit is surrounded with a raised deck on all sides and the rear, along with raised rails on the inner portion of the deck sides. In order to keep the vessel afloat, cellular plastic floation is required. The result is a stable but relatively heavy and unresponsive vehicle.

U.S. Pat. No. 4,231,315, issued to Tachibana, discloses another water jet propelled vessel which is designed to have a substantial draft when operated at low speeds. This condition is aggravated because the vehicle is designed to carry two persons. In order to avoid an objectionably high angle of the bow above the surface of the water, the jet pump discharge nozzle is directed not only rearwardly, but also downwardly, thereby imparting a substantial upward vertical component of force to the stern of the vessel (column 3, lines 43–53).

An alternate method of achieving longitudinal stability in a two person watercraft is disclosed in U.S. Pat. No. 4,341,177, issued to Miyazaki. The Miyazaki vehicle has an objectionably large draft for responsive handling, yet must maintain a fairly high degree of submergence in order to prevent air entrainment in the jet pump. In order to solve this problem, Miyazaki incorporates "water accommodation compartments" within the hull of the vessel, the compartments serving as movable ballast which is shifted in order to maintain the proper longitudinal trim throughout the various cruising regimes (column 2, lines 44–68).

Another attitude adjustment device used to prevent air entrainment within a jet pump is disclosed by Smoot in U.S. Pat. No. 4,523,536. Smoot utilizes air bags C and D which may be inflated as necessary to provide consistent water inflow to the jet pump intakes (column 5, lines 8–32).

Other solutions have involved modifications to the hull contour in order to achieve satisfactory jet pump operation. For example, U.S. Pat. No. 1,837,508, issued to Volf, discloses the use of longitudinal grooves on the bottom of the hull within which air is pumped, the pressurized air tending to support the stern portion of the vessel (page 1, lines 75–77).

Another example of a hull modification, this one designed specifically for water entrainment, is disclosed by Nevitt in U.S. Pat. No. 2,931,134. Nevitt uses a small semi-circular tunnel to capture water as the hull is dragged along the surface. The Nevitt vessel is not self propelled (column 2, lines 44–53).

A final example of an attempt to improve water entrainment is disclosed in U.S. Pat. No. 3,076,426, issued to Alexander. A series of perforations are made in a false bottom of the hull, the apertures emitting water to a compartment 28 which leads to the intake of the jet pump itself. Water tends to accumulate within the compartment 28 thereby preventing air entrainment during maneuvering (column 2, lines 47–52 and 65–70).

As can be seen from these examples of related technology, the solutions to the problem of maintaining consistent water entrainment to a jet pump have been characterized by somewhat complex and inefficient devices. The solutions have tended to add drag and weight to the vehicle, and have improved the vehicle's hydrodynamic profile only at the expense of increased overall displacement. The present invention addresses the problems of the prior art by, among other things, the development of a new hull profile which both improves the hydrodynamic performance of the vehicle while ensuring consistent water entrainment and jet pump operation throughout the entire range of radical high speed maneuvering.

SUMMARY OF THE INVENTION

The present invention comprises a power driven marine vessel, preferably in the form of a jet propelled boat, comprising an improved hull profile that tends to enhance hydrodynamic performance while increasing the water entrainment, which is essential to the operation of a jet pump, throughout its entire performance range. The vessel also includes several features which enhance safety, both during maintenance operations, such as refueling, and during maneuvering, such as in the performance of high speed turns.

The improved hull profile is derived primarily from the inclusion of a centrally located, longitudinal groove having a concave profile which extends along the keel of the vessel from a point beginning near the bow and terminating at the intake at the jet pump. The concave groove resides on a centrally located sponson which extends from a point near the bow and continues to the stern of the vessel. The jet pump inlet comprises a substantially rectangular opening having a contoured aft portion to enhance water entrainment and reduce hydrodynamic drag.

Other novel features of a vessel constructed according to the present invention include the combination of a steering/nozzle deflection system which, in combination with the hull design, permits maximum deflection of the steering wheel and simultaneous maximum application of engine power without any tendency of the vessel to develop lateral instability and capsize.

Another object of the present invention is to improve the safety and maintainability of the vehicle. Accordingly, the gasoline tank resides in a separate fuel container below the passenger seat cushion, removing gas container from proximity of engine compartment for safety purposes.

These and other objects and advantages of the invention will become apparent from the following detailed description and the accompanying drawings.

DESCRIPTION OF THE PREFERRED EMBODIMENT

Figure 1:
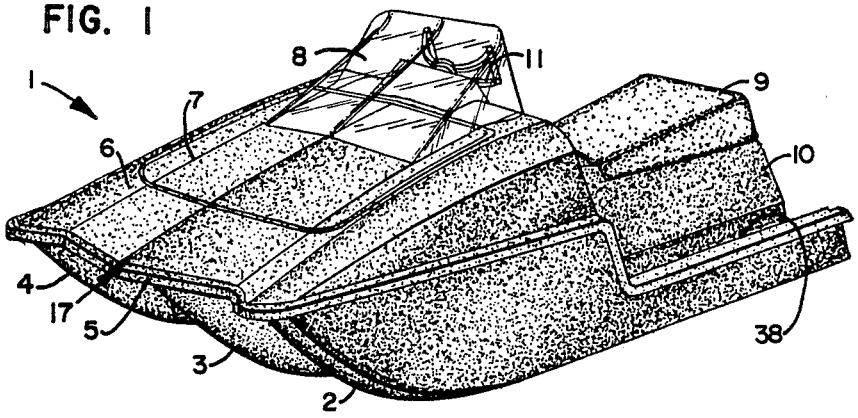
FIG. 1 is a perspective view of the water jet driven aquatic vehicle according to the present invention.

As best viewed in FIG. 1, an aquatic vehicle according to the present invention is shown generally at 1. The hull is generally formed having a port section 2, a center section 3 and a starboard section 4. The bow 6 of the vessel is guarded by bumper 5, which may be formed either as an integral part of the vessel structure, or as a separate strip of rubber, plastic or other resilient material affixed to the parent structure. Hull 60 may further be defined as having a first portion **60*b* which is located approximately at the midway point of the hull and a second portion 60*a* which is located at the forwardmost point of the hull. The two planes formed by the first portion 60*a* and second portion 60*b* of hull 60** being approximately perpendicular to one another.

The forward portion of the vessel comprises bow 6, the bow meeting the hull at bumper 5 generally at a height of approximately a foot above the bottom 16 of the vessel, the bow 6 sloping gently upward as it extends towards the stern of the vessel.

The engine is housed beneath bow 6, the engine being accessible by removing engine cover plate 7 which fits within bow 6 to form a flush surface contour. Also visible in FIG. 1 is the windshield 8 which is fastened to engine cover plate 7 and which remains affixed to cover plate 7 as a single unit when the cover plate is removed for engine maintenance.

When in use, the operator of the vehicle sits on seat cushion 9 which is supported by seat assembly 10. In the preferred embodiment, the entire hull structure, including port section 2, center section 3, starboard section 4, bow 6 and seat assembly 10 are formed as a single integrated structure, preferably of glass fibers or other lightweight composite material not subject to corrosion in a marine environment. The operator of the craft controls the direction of the vehicle by means of steering wheel 11, the steering wheel being linked to the jet pump nozzle assembly 12 which is deflected to correspond to the movement of the steering wheel.

Figure 2:
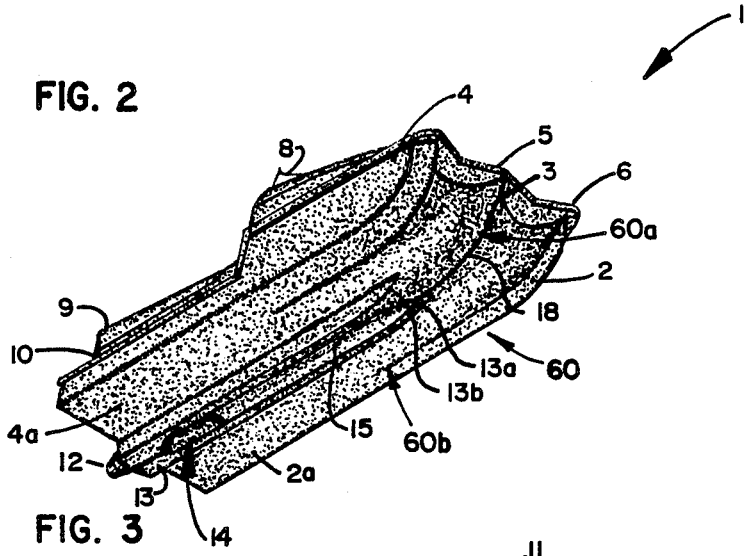
FIG. 2 is a perspective view of the vehicle according to FIG. 1 as viewed from beneath.
Figure 3:
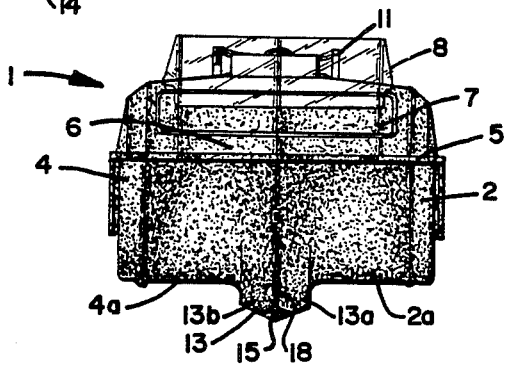
FIG. 3 is a front elevation of the vehicle according to FIG. 1 with most of the vehicle accessories removed, thereby more clearly depicting the hull profile.

As best seen in FIGS. 2 and 3, the jet pump nozzle 12 is mounted at the stern of the vessel. The hull center section 3 tapers to a single edge near the bow 6, but as it extends towards the stern of the vessel a generally rectangular sponson 13 is formed, the sponson extending approximately six inches below the horizontal plane defined by port stern section **2*a* and starboard stern section 4*a***.

The jet pump itself is mounted in an internal portion of sponson 13 adjacent to nozzle 12. Water is admitted to the jet pump impeller through orifice 14.

Figure 10:
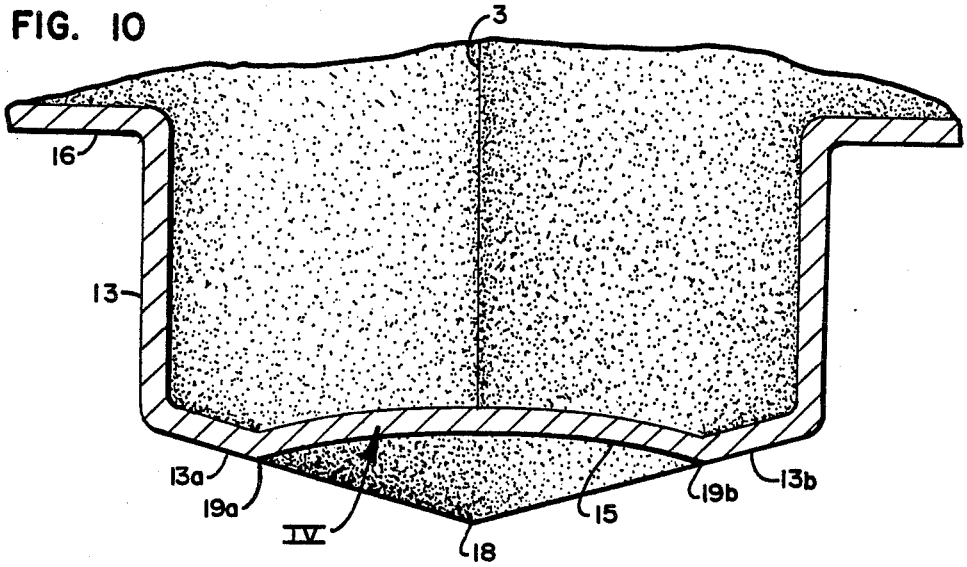
FIG. 10 is a partial cross sectional view taken along line 10—10 in FIG. 7, depicting the concave profile of the central longitudinal groove.
Figure 7:
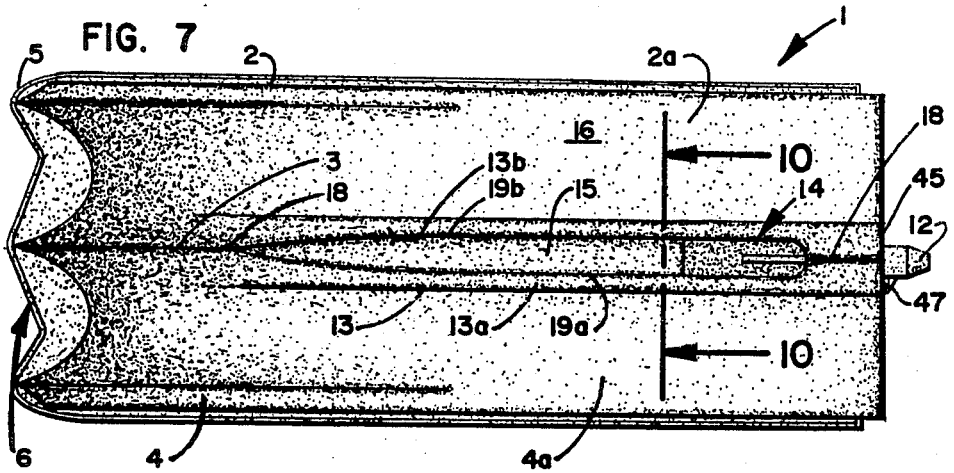
FIG. 7 is a bottom plan view of a second embodiment aquatic vehicle as shown in FIG. 1.

One novel feature of the present invention resides in the centrally located concave groove 15 used to entrain water which is ultimately admitted to jet pump intake orifice 14. As best seen in FIGS. 2, 7 and 10, the elongated groove 15 is located on sponson 13. More specifically, as center bow section 3 sweeps towards the stern of the boat, sponson 13 gradually begins to drop below the horizontal bottom plane 16 which defines the bottom of the vessel. Thus, the foreward portion **13*a* of sponson 13 becomes perceptible at a point near the rear of center bow section 3, corresponding to a distance which is displaced sternward approximately $\frac{1}{3}$ to $\frac{1}{4}$ the length of the vessel from the forward most point 17 of bow 6**.

The groove 15 deepens gradually after beginning at tip 18 which generally coincides with the forward section **13*a* of sponson 13. Groove 15 tapers gradually toward tip 18 from the stern of the vessel and reaches its full width at a point which corresponds to the approximate midpoint of the vessel. The actual location and size of the transition of groove 15** from its forward taper to its full width may be varied according to the particular vessel on which it is employed and not limited to application on sponsons and including boat hulls, depending on such parameters as overall aspect ratio of the hull planform, engine horsepower, speed range, recommended cruising speed, degree of maximum available nozzle deflection and the like.

As may best be view in FIG. 10, the profile of groove 15 is shallowly concave, having a width which occupies approximately 60 to 90 percent of the width of the sponson 13. The depth of the groove 15 varies from approximately 5 percent to 60 percent of the overall height of sponson 13. The profile of groove 15 must be adapted according to the needs of a particular vessel on which it is used, but must in general be deep enough to provide adequate water entrainment for use by the jet pump even during maximum performance maneuvering, yet be shallow enough to present low hydrodynamic drag and prevent the entrainment of air along with the entrained water. Typically, a smaller engine (one delivering less power output) requires a shorter groove, while a larger engine utilizes a longer groove. The overall volume of the groove 15 based on its length, width, vertical profile, and taper must be sufficiently large to ensure a constant supply of water to the jet pump, while any groove volume provided in excess of that minimum requirement represents unnecessary hydrodynamic drag and increases the risk of unwanted air entrainment or overloading the pump and engine. Similarly, the height and width of sponson 13 must also be adjusted according to the specific requirements of an individual vessel in order to ensure both lateral stability and sufficient water entrainment to the jet pump. Ideally, the sponson 13 is large enough to accommodate a substantial portion of the jet pump impeller and nozzle.

As best viewed in FIGS. 3 and 10, the lower port surface **13*a* and lower starboard surface 13*b* are inclined somewhat from a horizontal plane as is required for best hydrodynamic efficiency. Similarly, the port transition zone 19*a* and starboard transition zone 19*b* which represent the interface between the groove 15 and sponson 13** must be contoured to reduce hydrodynamic drag.

As previously stated, entrainment groove insures a constant supply of water to the pump, thusly preventing an occurence known as cavitation, which is a loading and unloading of the pump. This is an important safety feature being that the suction of the pump draws the craft down against the water. If suction is lost, adhesion to the water is diminished by a noticable degree especially in turning maneuvers.

Figure 9:
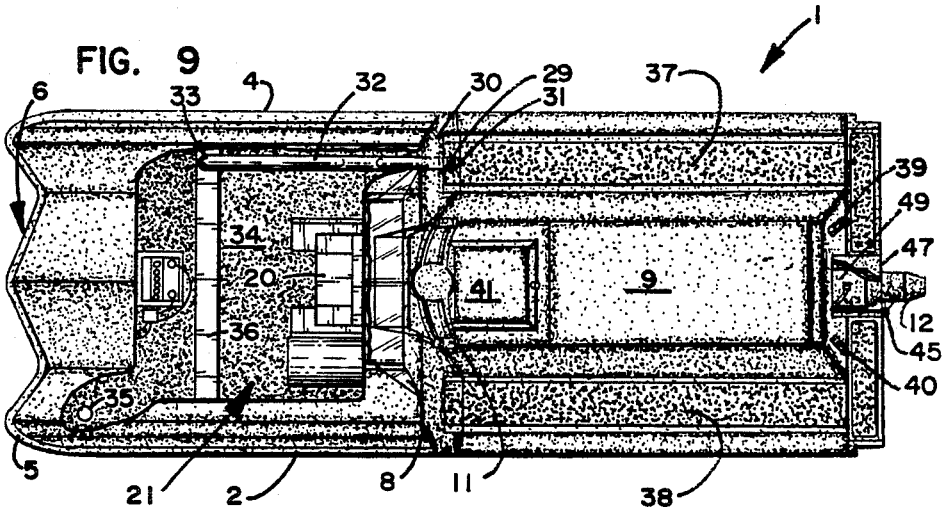
FIG. 9 is a top plan of the aquatic vehicle shown in FIG. 1 with portions of the engine compartment broken away.

Another novel aspect of the present invention resides in the manner in which the fuel supply is housed within the vessel. As best seen in FIG. 9, the engine 20 is housed within engine compartment 21 which resides generally beneath bow section 6. Access to engine 20 and engine compartment 21 may be achieved by removal of engine cover plate 7. In other vessels of this type, the fuel is typically housed in the forward section, thus greatly increasing the danger of accidental fire, or even explosion, should the boat be involved in a collision, especially due to the proximity of the fuel to the warm engine.

Figure 8:
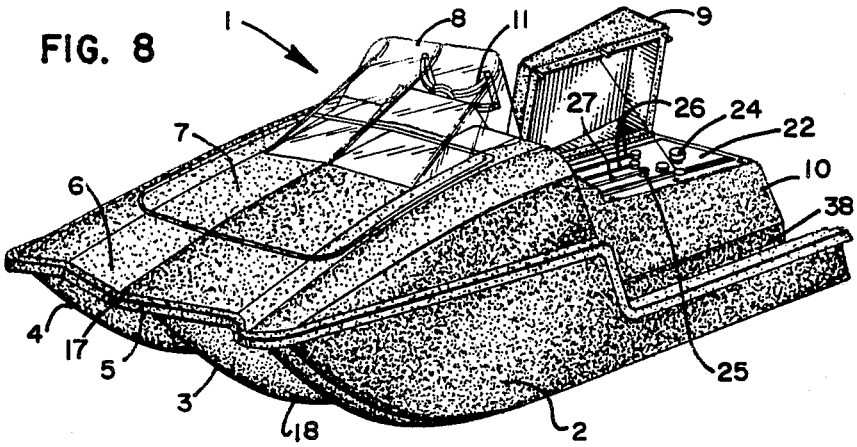
FIG. 8 is perspective view of the aquatic vehicle as shown in FIG. 1 as viewed from above.

In the present invention, the fuel is located near the stern of the vessel. Referring now to FIG. 8, the fuel is housed in fuel tank 22, the tank being any one of a variety of approved gasoline containers, typically of metal or plastic construction, and having a capacity of approximately five to ten gallons. The fuel tank 22 may be filled by removing cap 24 which may be located conveniently on the top surface of the fuel tank 22. Fuel travels from fuel tank 22 to the engine 20 by existing through valve 25 which is connected to fuel line 26. Fuel tank 22 may also contain an additional vent orifice which is connected to vent line 27.

The fuel tank 22 is housed within seat assembly 10, and indeed serves as part of the seat support structure. Seat 9 fits directly on top of seat assembly 10 and is of sufficient length to support both the operator of the vehicle and a passenger seated in tandem.

Another novel aspect of the present invention resides in the manner in which air is introduced into the engine compartment so as to prevent flooding of the engine compartment 21 in the case of capsizing or submergence. Air is initially introduced into the interior of the vessel via air inlet 29. In the preferred embodiment, air inlet 29 is located on the starboard side of fire wall 30, but may be relocated to best accommodate the particular vessel architecture. Air inlet 29 is covered with a filter 31 which may be of any conventional wire mesh or Coast Guard approved foam construction. Air inlet 29 represents the first terminal end of air hose 32 which is housed within engine compartment 21. A short distance toward the bow from air inlet 29, air hose 32 ascends to a point which is very near the upper portion of engine compartment 21 adjacent to the top surface of bow 6. Immediately thereafter, air hose 32 follows a path downwardly, passing through air hose orifice 33, orifice 33 having been cut through the wall of engine compartment keel 34. Air hose 32 passes beneath engine compartment keel 34, and reaches a low point which corresponds roughly to a point along the longitudinal center line of the vessel. Air hose 32 then follows an upward path terminating in air intake stack 35. Air intake stack 35 is generally formed as a cylinder open at the top which is mounted on engine compartment keel 34 and extends upwardly to within approximately an inch of the upper surface of the engine compartment 21 as defined by bow surface 6. Regardless of the position cocupied by vessel 1, whether upright or otherwise, and despite its degree of submergence, water cannot enter engine compartment 21 as a result of the alignment of the air intake system. The presence of a high point and a low point, along with the configuration of air intake stack 35 prevents water from entering the air intake system or engine compartment 21, provided that engine cover plate 7 preserves a water tight seal with bow 6.

Another unique feature of air intake system is its ability to dramatically reduce the operating decibel level. By routing the air intake system through hull compartments sound amplitude is reduced further. Sound amplitude is reduced by foam lining of the hull to deaden intake noise. Directional changes of air as it winds its way through intake hoses and hull compartments further constitutes sound amplitude reduction. This is a significant advancement in light of noise pollution as related to ecology and environmental laws.

Figure 4:
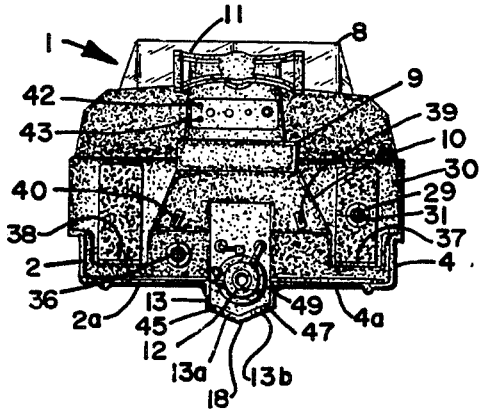
FIG. 4 is a rear elevation of an aquatic vehicle as shown in FIG. 1, with the inclusion of most of the accessory and mechanical equipment.
Figure 5:
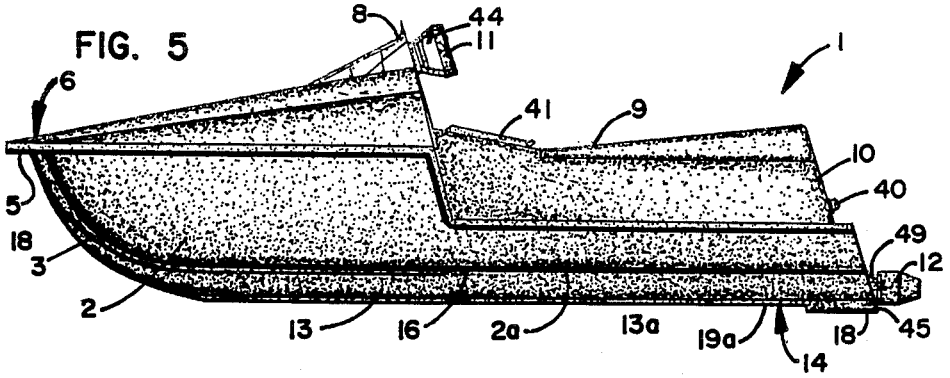
FIG. 5 is a side elevation view of a second embodiment of the aquatic vehicle shown in FIG. 1.
Figure 6:
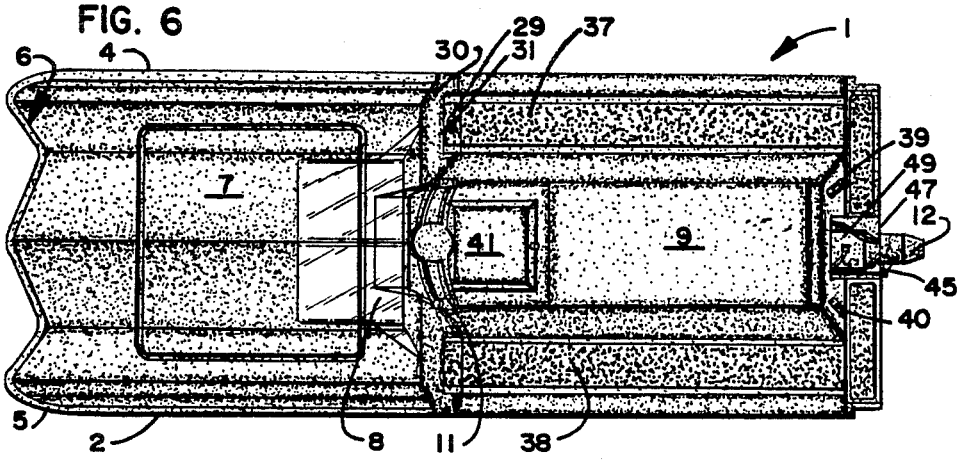
FIG. 6 is a top plan view of a second embodiment aquatic vehicle as shown in FIG. 1.

Exhaust gases from engine compartment 21 are similarly routed to an exhaust hose system incorporating both high and low points such that water cannot enter engine compartment 21 through the exhaust line. Exhaust gases are vented overboard by exhaust port 36, as best seen in FIG. 4. The engine provides a self-ventilating function insofar as air or other gases within the engine compartment 21 is forced to escape by traveling through the engine, thus ventilating the hull and preventing harmful gas build up.

During operation of the vessel, the operator sits on seat 9 facing towards the bow. The operator's feet typically rest in starboard channel 37 and port channel 38. If desired, two persons may occupy the vessel by sitting on seat 9 in tandem. A water skier may also be pulled by the vessel, the ski tow rope being attached through starboard hook 39 and port hook 40. Small personal items may be stored within storage compartment 41 which is located immediately in front of seat 9 and below steering wheel 11.

The engine 20 may be started by depressing starter button 42 which is accessible to the operator on control panel 43. The engine throttle is controlled by finger switch 44 which is accessible to the fingers of the operator while gripping steering wheel 11. The direction of the vehicle may be controlled by rotating steering wheel 11 either clockwise by a turn to starboard or counterclockwise by a turn to port. Steering is accomplished by a mechanical linkage 45 which causes the nozzle to deflect to starboard for a starboard turn and to deflect to port for a port turn. The steering linkage mechanism and the deflection of nozzle 12 are interconnected such that when the steering wheel 11 is fully deflected in either direction, the deflection of nozzle 12 is limited to the extent that, even with full depression of finger switch 44 which corresponds to full throttle, the vessel is stable and is in no danger of capsizing. Indeed, in this manner, a maximum performance, minimum radius turn may be accomplished with ease and complete safety.

Other novel features of the present invention reside in the manner in which fuel vapors are evacuated continuously from the fuel compartment 22. A first end 26 of vent line 27 is connected to a suitable fitting which permits access to the interior of fuel tank 22. A second end 47 of vent line 27 is connected to nozzle 12 by entering through a fitting which passes substantially perpendicularly through the side of nozzle 12. The net effect of this arrangement is that as water is ejected through nozzle 12 during normal operation, a low pressure venturi effect is created as the water passes by the second end 47 of vent line 27. Therefore, air is drawn through vent line 27 from fuel tank 22 towards nozzle 12 and thereby evacuated from container 22 and out through nozzle 12 along the water used to propel the boat.

We claim:

1. An aquatic vessel comprising:

(a) a hull structure, the hull structure having a substantially rectangular planform, the hull having a length and width, the length being approximately twice the width, the hull having a bow, a stern, a top surface and a bottom surface;

(b) an operator support structure, the operator support structure being located on the top surface of the hull adjacent to the stern, the operator support structure being sufficiently large to accommodate two persons straddling the support structure in tandem;

(c) an operator control console, the control console being located approximately midway between the stern and bow of the hull and on the top surface of the hull, the control console accommodating a steering wheel which is accessible to persons seated on the operator support structure;

(d) an engine, the engine being located on the top surface of the hull adjacent to the bow so as to maintain longitudinal trim;

(e) an impeller assembly, the impeller assembly being located adjacent to the stern and the bottom of the hull, the impeller assembly being powered by the engine;

(f) a water inlet port, the water inlet port perforating the bottom surface of the hull near the stern and forward of the impeller assembly such that water may enter the impeller assembly and be ejected therefrom, thereby propelling the vessel;

(g) a center section, the center section being centrally, longitudinally aligned and integrally formed with the bottom surface of the hull, the center section defining a longitudinal axis and the center section beginning at the stern of the vessel and extending towards the bow for a distance varying from 10% to 90% of the length of the hull; and (h) a water entrainment groove, the groove being centrally, longitudinally aligned with the center section, the groove extending from a point coincident with the forward most portion of the center section and extending toward the stern and terminating adjacent to the water inlet port, the groove having a length and the groove defining a longitudinal axis, the longitudinal axis of the groove being parallel to the longitudinal axis of the center section.

2. A vessel according to claim 1, further comprising:

(a) a center section, the center section being centrally, longitudinally aligned and integrally formed with the bottom surface of the hull, the center section beginning at the stern of the vessel and extending towards the bow for a distance varying from 10% to 90% of the length of the hull; and (b) an impeller assembly housing compartment, the housing compartment being formed internally within the center section, the housing compartment being located adjacent to the stern of the vessel, the impeller assembly being powered by a shaft longitudinally aligned within the center section, the shaft being driven by the engine.

3. An aquatic vessel according to claim 2, further comprising a directional nozzle, the directional nozzle residing adjacent to the stern of the center section, the directional nozzle responding to input from the steering wheel such that deflection from the steering wheel causes the directional nozzle to deflect, thereby controlling directional heading of the vessel.

4. An aquatic vessel according to claim 3, wherein the longitudinal groove is substantially concave, the concavity being formed as a shallow circumferential arc, the groove having a depth of 5 percent to 30 percent of the total center section depth.

5. An aquatic vessel according to claim 4, further comprising:

(a) an engine compartment, the engine compartment residing within the bow of the hull, the engine compartment being substantially watertight, the engine compartment being accessible by means of a cover which is a removable portion of an upper surface of the engine compartment;

(b) an air inlet path, the air inlet path comprising a conduit, the conduit having a first end and a second end, the first end perforating a wall in the engine compartment so as to admit air into the conduit, the second end terminating within the engine compartment so as to admit air to the engine in order to support combustion.

6. An aquatic vessel according to claim 5, wherein the steering wheel is interconnected to the nozzle by means of a steering linkage, the interaction of the steering wheel, the steering linkage and the nozzle being such that when the steering wheel is fully deflected, corresponding to full deflection of the nozzle, the full nozzle deflection is limited such that the axes of the hull corresponding to the hull's length and width remain in a relatively horizontal configuration.

7. An aquatic vessel according to claim 6, including a fuel system, wherein the fuel system comprises:

(a) a fuel container, the fuel container being an enclosure capable of housing petroleum based fuel products for relatively long periods of time;

(b) a fuel evacuation orifice, the fuel evacuation orifice permitting fuel to be withdrawn from the fuel container;

(c) a fuel hose, the fuel hose being connected to the fuel evacuation orifice and leading to the engine, thereby supplying fuel to the engine;

(d) an air evacuation orifice, the air evacuation orifice perforating the fuel container so as to permit evacuation of fuel vapors from the fuel container;

(e) a vent hose, the vent hose having a first end and a second end, with the first end of the vent hose attached to the air evacuation orifice;

(f) a nozzle fitting, the nozzle fitting being attached to the second end of the air evacuation hose and passing through the side wall of the nozzle, the ejection of water through the nozzle creating an area of low pressure adjacent to the air evacuation nozzle fitting, thereby drawing fuel vapors from the fuel container to be discharged through the nozzle along with the ejected water.

8. An improved hull for use with an aquatic vessel, comprising:

(a) a hull bottom, the hull bottom having a length and a width, the hull bottom having a substantially rectangular planform wherein the length exceeds the width, the hull bottom having a bottom surface;

(b) a three-lobed bow section, the three-lobed bow section including a center section, a starboard section, and a port section, the three-lobed bow section being formed integrally with the hull bottom, the three-lobed bow section beginning approximately at the midsection of the hull and following a curvilinear path such that a first portion of the three-lobed bow section adjacent to the midpoint of the hull is substantially perpendicular to a second portion of the three-lobed bow section which constitutes the forwardmost point of the hull;

(c) a planar horizontal stern section, the planar horizontal stern section extending from approximately the midpoint of the hull to the stern, the planar stern section defining a substantially horizontal plane when the aquatic vessel is floating in a body of water;

(d) a dropped center section, the dropped center section being substantially rectangular in plan form, the dropped center section having a width of approximately 1/5 of the overall width of the hull, the dropped center section having a length of approximately $\frac{2}{3}$ of the length of the hull, the dropped center section having substantially a zero height at its initial point near the bow of the vessel, and tapering forwardly at a relatively small angle and inclined to the horizontal plane defined by the planar stern section, the dropped center section being centrally, longitudinally aligned and integrally formed with the bottom surface of the hull;

(e) a groove, the groove being centrally, longitudinally aligned and formed within a portion of the dropped center section, the groove having a concave profile such that water tends to be entrained within the groove when the hull is advanced along the surface of water.

* * * * *

UNITED STATES PATENT AND TRADEMARK OFFICE

CERTIFICATE OF CORRECTION

PATENT NO. : 4,781,141

DATED : November 1, 1988

INVENTOR(S) : Edward H. Webb, Marley Duclo, Lonn M. Peterson

It is certified that error appears in the above-identified patent and that said Letters Patent is hereby corrected as shown below:

In column 1, line 32, please delete "dimunitive" and substitute therefore --diminutive--.

In column 1, line 39-40, please delete "manuevers" and substitute therefore --maneuvers--.

In column 1, line 45, please delete "is" and substitute therefore --in--.

In column 4, line 22, please delete "objects" and substitute therefore --objectives--.

In column 5, line 44, please delete "foreward" and substitute therefore --forward--.

In column 5, line 64, please delete, "view" and substitute therefore --viewed--.

In column 6, line 37, please delete "noticable" and substitute therefore --noticeable--.

In column 6, line 60, please delete "existing" and substitute therefore --exiting--.

In column 9, line 18, please delete "comprising:" and substitute therefore --comprising--.

In column 9, please delete lines 19-24.

UNITED STATES PATENT AND TRADEMARK OFFICE

CERTIFICATE OF CORRECTION

PATENT NO. : 4,781,141

DATED : November 1, 1988

INVENTOR(S) : Edward H. Webb et al

It is certified that error appears in the above-identified patent and that said Letters Patent is hereby corrected as shown below:

In column 9, line 25, please delete "(b)".

Signed and Sealed this

Twenty-fifth Day of April, 1989

*Attest:*

DONALD J. QUIGG

*Attesting Officer*

*Commissioner of Patents and Trademarks*